United States Patent [19]

Bentall

[11] 4,204,360

[45] May 27, 1980

[54] SEGMENTAL WALKING TOY

[75] Inventor: Simon W. Bentall, West Croydon, England

[73] Assignee: Hilary Page "Sensible" Toys Limited, Kenley, England

[21] Appl. No.: 907,302

[22] Filed: May 18, 1978

[30] Foreign Application Priority Data

May 18, 1977 [GB] United Kingdom ..... 20938/77

[51] Int. Cl.[2] ..... A63H 5/00; A63H 13/02

[52] U.S. Cl. ..... 46/98; 46/105; 46/204

[58] Field of Search ..... 46/98, 103–105, 46/204, 205

[56] References Cited

U.S. PATENT DOCUMENTS

| | | | |
|---|---|---|---|
| 750,506 | 1/1904 | Wells | 46/98 |
| 2,424,607 | 7/1947 | Fisher | 46/104 |
| 2,724,925 | 1/1955 | Fisher et al. | 46/204 X |
| 3,191,343 | 6/1965 | Goldfarb | 46/103 |
| 3,555,722 | 1/1971 | McLain et al. | 46/103 |

FOREIGN PATENT DOCUMENTS

| | | | |
|---|---|---|---|
| 994706 | 11/1951 | France | 46/104 |

*Primary Examiner*—Charles E. Phillips

*Attorney, Agent, or Firm*—Emory L. Groff, Jr.

[57] ABSTRACT

A toy representing a caterpiller with a number of units constructed as two-part shells with coupling rods joining adjacent units so as to afford limited relative movement between the units, each unit having a pair of wheels mounted eccentrically on each axle and a pair of freely hanging leg members pivoted to each side of the unit to produce a "waddling" walking effect when the toy is pulled along by a cord on the front unit.

7 Claims, 6 Drawing Figures

SEGMENTAL WALKING TOY

This invention relates to an improved pull along toy comprising a multiplicity of substantially identical units forming segments which are interlinked with each segment having a pair of ground bearing wheels. The front and rear unit forming the toy will generally be different or at least modified to provide, for example, a head with a pull cord attached thereto, and a tail. In the past such toys have been constructed with each segment thereof of wood, which does not allow changes to be made to the design in a simple manner, and with cords serving to interconnect the segments, which allows two adjacent segments to rotate and thus twist the cords when a child lifts the toy from the ground.

Our British patent specification No. 1122570 describes a toy of the above kind including the feature of a number of legs so arranged to give a walking and "waddling" effect.

It is an object of this invention to provide a construction of toy which affords freedom of movement of the individual segments to give a realistic effect but which prevents excessive movement when the toy is lifted bodily from the ground.

A further object is to provide a construction for a unit which allows simple manufacturing and assembly techniques to be used.

According to this invention there is provided a unit, a number of which may be interconnected to form a segmental toy, wherein said unit comprises upper and lower shells which are interconnected, preferably detachably, the lower shell carrying an axle with ground bearing wheels at each side, the two shells, when connected including a post with a rod pivoted thereto and projecting through a slot at the front or the rear, or both of the unit, the projecting part of the rod being adapted for attachment to the post of another unit and forming a connecting means.

The upper shell may be generally hemispherical or may be shaped as a receptacle or "truck."

The wheels will preferably be mounted on the axle in an offset manner whereby the unit performs a side-to-side rocking motion when pulled along. The upper shell may include leg members which depend from and are freely pivoted on stub axles and arranged so that as the unit performs a side-to-side motion the legs brush the ground surface and are carried back at one position of rotation of respective wheels and swing freely forward at the other position of the wheels. This produces a walking effect. Each unit is connected to the next preferably by two rods each with an eye at each of its ends through which the posts of respective unit pass. The rods are generally parallel and spaced by bends or the like, and afford sufficient relative movement between adjacent units to allow a relative rocking motion and a sinuous path to be followed but insufficient movement to allow adjacent segments to rotate too far out of alignment. Thus the toy as a whole can be placed wheels down on a surface without individual segments having to be orientated to ensure all wheels are on the ground.

An embodiment of a unit and a toy incorporating same together with further preferred features are shown in the accompanying drawings wherein.

Figure 1:
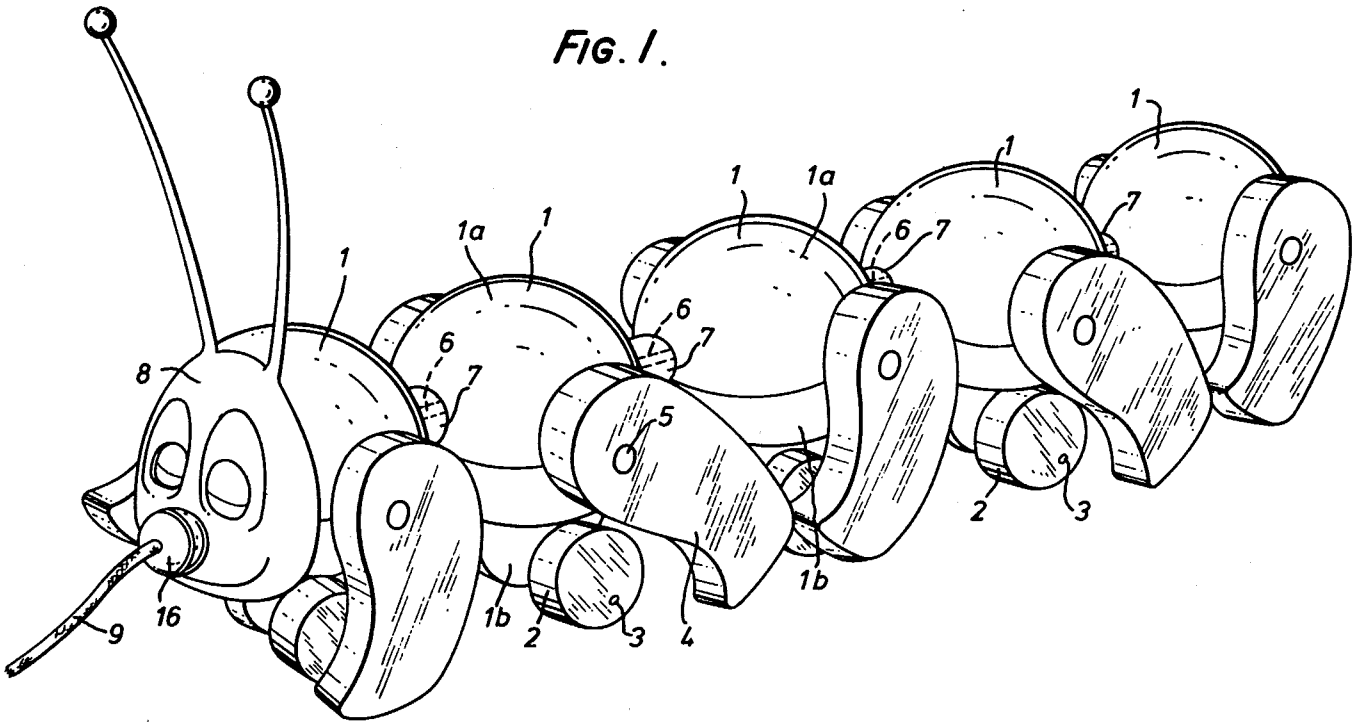
FIG. 1 shows a toy made up from a number of units according to the invention.

FIG. 1 shows a pull along toy intended to represent a caterpillar and comprising five similar segments 1 each being a unit in accordance with the invention. Each unit has an upper shell 1*a* and a lower shell 1*b* which carries a transverse axle 3 on which wheels 2 are mounted at each end. The wheels are mounted eccentrically with the respective positions of the axes out of phase. By this means each unit moves from side-to-side or "sways" and gyrates as the wheels rotate over a surface. The upper shell 1*a* has legs 4 free to swing about pivots 5 and the length of the legs is arranged so that they alternately brush the ground to be carried back and then swing forward freely as the side of the unit falls and then rises due to the wheels eccentricity. Each unit is connected to the next by two parallel coupling rods 6 spaced by beads 7. A mask 8 is secured to the front unit and a pull cord 9 is attached thereto.

The mode of interconnection between adjacent units affords limited movement about a longitudinal axis, so that each unit may sway independently of the next, and about a vertical axis, so that the toy may be pulled along a sinuous path. In addition the mechanical actions during movement creates noise. This may be further enhanced by including a marble in the body shell.

Figure 2:
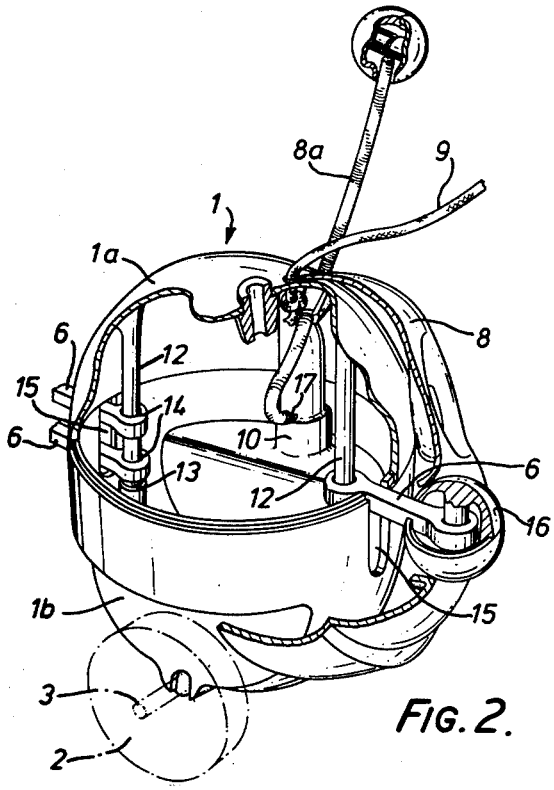
FIG. 2 is a part cut-away view of a unit forming the head.

FIG. 2 shows in detail a front unit for a toy of modified construction, the other units coupled thereto are similar except for the mask part 8, antennae 8*a* and pull cord 9.

Figure 3:
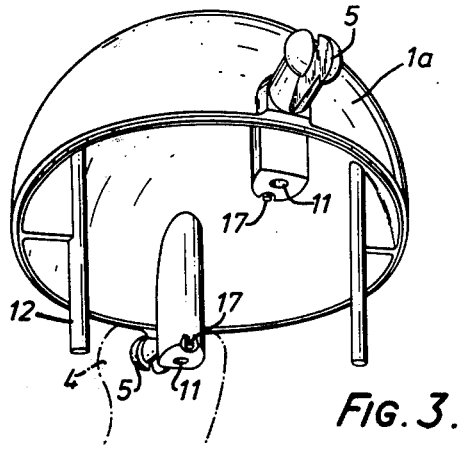
FIG. 3 shows a side view of the upper shell of the unit for carrying legs.

FIG. 3 shows the upper shell 1*a*. Referring to these drawings the two shells 1*a* and 1*b* are secured together by screws inserted through bosses 10 from below the shell 1*b* and entering apertures 11 in the upper shell 1*a*. The upper shell has depending posts 12 which enter bores 13 in the lower shell and which pass, with clearance, through eyes 14 in the ends of the rods 6 which extend, again with clearance through slots 15 in the lower shell. The other ends of the rods 6 have similar eyes 14 which engage the post 12 of the next unit. The front unit shown has one forwardly extending rod which connects with head 16 serving to retain mask 8. The upper shell is slightly modified by provision of apertures to accommodate the pull cord 9 and the helical wire antennae 8*a* which is attached to a peg 17 in the upper shell. For an intermediate unit two coupling rods 6 will extend both forwardly and backwards.

Figure 4:
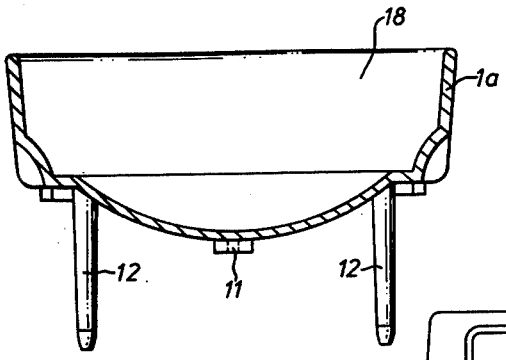
FIG. 4 shows a side view in section of the upper shell of a unit forming a truck.

FIG. 4 shows a different upper shell 1*a* and this forms a truck body. The upper shell is connected to the lower shell by apertures at 11 and includes posts 12 for attachment of the connecting members 6 but has a receptacle shaped recess 18 rather than being hemispherical. This unit has no legs 4. The upper shell is readily interchangeable by virtue of the connection being by screws.

Figure 5:
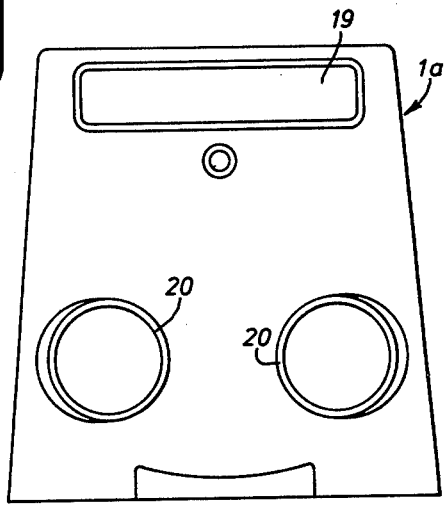
FIG. 5 shows a front view of the upper shell forming the first unit of a truck.
Figure 6:
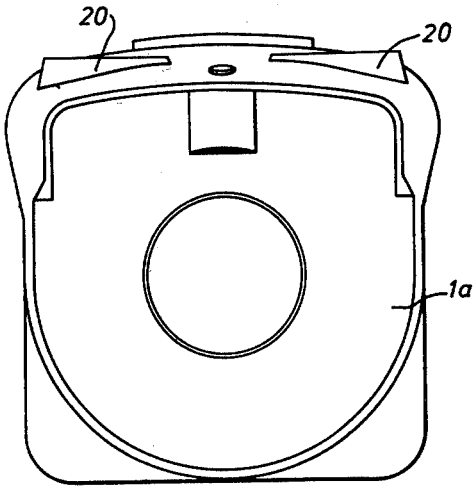
FIG. 6 shows a top plan view of the upper shell of FIG. 5.

In the case of a truck the front unit has a further different upper shell as shown in FIGS. 5 and 6. In this case only one post is provided at the rear and the front (mask) is moulded to represent a lorry cab with windscreen 19 and headlights 20.

The unit, by virtue of the construction using two shells, can be readily and simply adapted to different toys. Many other forms other than these described can be adopted.

I claim:

1. A toy comprising a number of interconnected units with each unit having a pair of ground bearing wheels carried by a stub axle, the units being interconnected in a manner permitting relative movement, characterised by a unit comprising upper and lower shells which are interconnected, the lower shell carrying an axle with the ground bearing wheels at each side, the two shells when connected including a post, a rod pivoted to the post and projecting through a slot in the unit, the projecting part of the rod attached to the post of another unit and forming a connecting means, said wheels mounted on the axle in an offset manner causing the unit to perform a side-to-side rocking motion when pulled along, the upper shell including stub axles on opposite sides thereof, leg members depending from said axles and freely pivoted thereon whereby as the unit performs a side-to-side rocking motion the legs brush the ground surface and are carried back at one position of rotation of respective wheels and swing freely forward at the other position of the wheels.

2. A toy according to claim 1 wherein, each unit is connected to the next by two rods each with an eye at each of its ends through which the posts of respective unit pass.

3. A toy according to claim 2 wherein, the rods are generally parallel and spaced by beads, and afford sufficient relative movement between adjacent units to allow a relative rocking motion and a sinuous path to be followed but insufficient movement to allow adjacent segments to rotate too far out of alignment.

4. A toy according to claim 1 wherein, an end unit includes a part forming a head piece with a pull cord secured thereto.

5. A unit or toy according to claim 1 wherein, one shell includes an integral post which engages a recess in the other shell with the post passing through an eye at the end of the or each rod, the rod projecting out of a slot within a shell part, the slot defining limits of pivotal movement of the rod about the post.

6. A unit or toy as claimed in claim 5 wherein, the shell includes two posts oppositely located with respective rods projecting through diametrically opposed slots.

7. A unit or toy according to claim 1 wherein, the shells include a free, noise producing member such as a marble.

* * * * *